US006015121A

United States Patent [19]

Reid

[11] Patent Number: 6,015,121

[45] Date of Patent: Jan. 18, 2000

[54] COLLAPSIBLE STAND

[76] Inventor: Martin Shaun Reid, 56 Cranbourne Avenue, Wanstead, London E11 2BQ, United Kingdom

[21] Appl. No.: 09/065,034

[22] PCT Filed: Nov. 21, 1996

[86] PCT No.: PCT/GB96/02867

§ 371 Date: Jun. 9, 1998

§ 102(e) Date: Jun. 9, 1998

[87] PCT Pub. No.: WO97/19443

PCT Pub. Date: May 29, 1997

[30] Foreign Application Priority Data

Nov. 22, 1995 [GB] United Kingdom ..... 9523913
Aug. 19, 1996 [GB] United Kingdom ..... 9617401

[51] Int. Cl.[7] ..... A47G 23/02

[52] U.S. Cl. ..... 248/150; 248/152; 248/174; 84/327

[58] Field of Search ..... 248/150, 152, 248/154, 174, 122.1, 443; 84/327, 421

[56] References Cited

U.S. PATENT DOCUMENTS 1,708,285 4/1929 Truett et al. ..... 84/327
1,949,607 3/1934 Harrold ..... 248/109
2,736,225 2/1956 Marcus ..... 84/280
2,743,499 5/1956 Edgerton ..... 84/327
4,099,441 7/1978 Landon ..... 84/327
4,213,369 7/1980 Swartwout ..... 84/284

*Primary Examiner*—Ramon O. Ramirez
*Assistant Examiner*—Gwendolyn Baxter
*Attorney, Agent, or Firm*—Young & Thompson

[57] ABSTRACT

A stand for supporting an item in an upright manner and which includes a base portion (1), a plurality of side portions (2) hinged to the base portion (1) so that they can be folded to be substantially flat with the base (1) or orientated at an angle to the base (1) for supporting the item, biasing element (26, 27) responsive to the item being inserted in the stand to bias each side portion into contact with the item for support in the stand, and an element (8) for supporting each side portion at an angle to the base against the bias force direction wherein each side portion supporting element (8) is releasable for folding the stand.

42 Claims, 9 Drawing Sheets

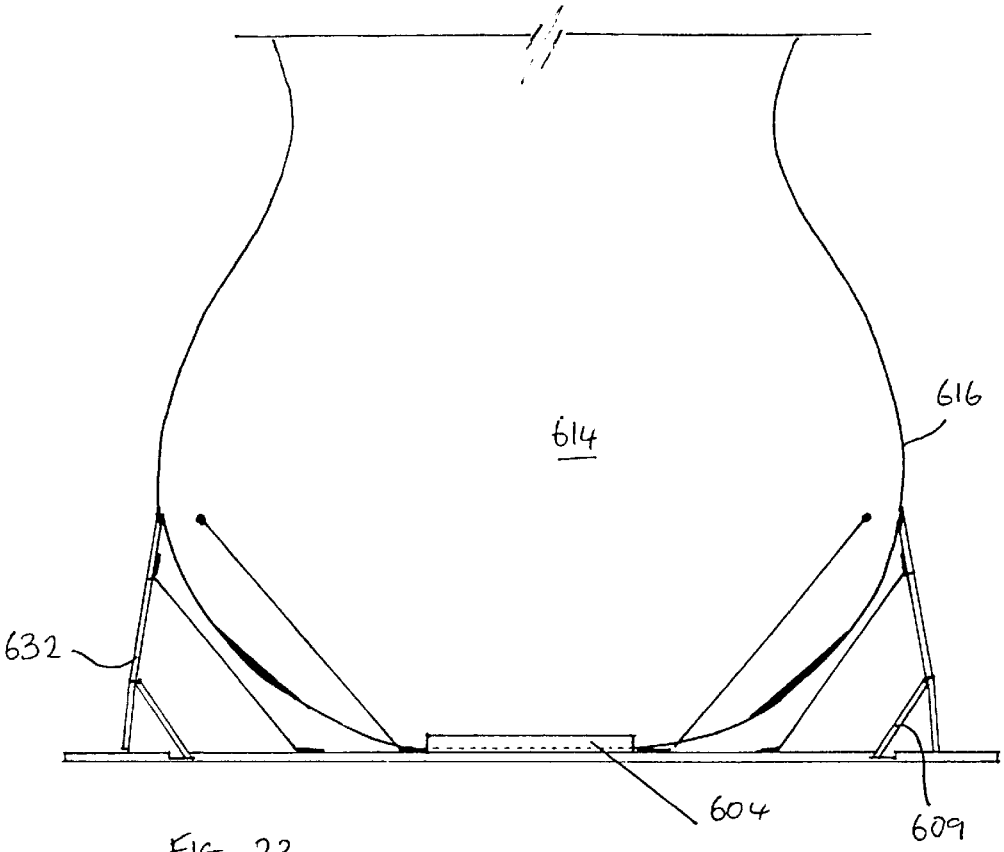
FIG. 23
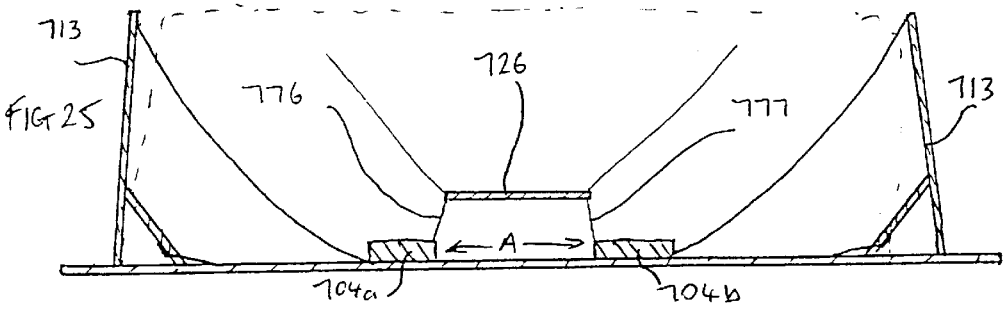
FIG. 24
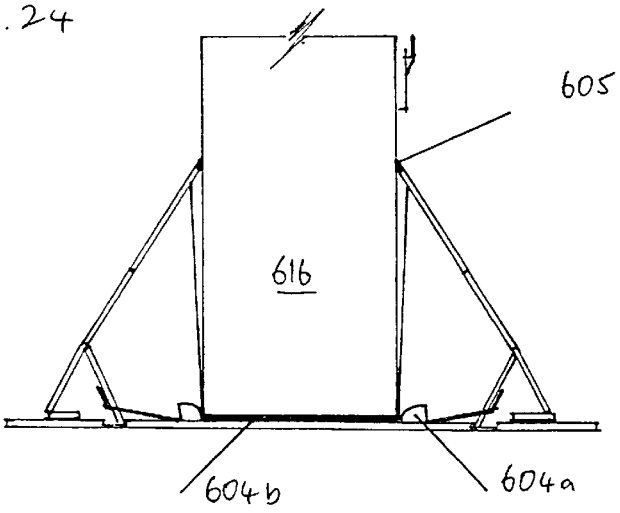

COLLAPSIBLE STAND

FIELD OF THE INVENTION

This invention relates to a collapsible stand, particularly for use with musical instruments such as guitars.

BACKGROUND OF THE INVENTION

A guitar stand supports a guitar, when not in use, in an upright or near-upright position. Instruments such as guitars are space consuming and only rarely does a practical situation permit the instrument to be laid flat on the floor. This is hazardous and is also inconvenient since the user must then bend or stoop when re-use is required. However if the instrument is balanced against an upright fixture, such as a wall, or a music stand, it is vulnerable to being knocked and to damage if it falls.

Guitar stands are normally constructed of metal rod or tube with rubber pads at strategic points to prevent damage to the instrument. This construction makes the known stands relatively expensive, somewhat heavy and cumbersome to carry and erect.

SUMMARY OF THE INVENTION

According to the present invention there is provided a stand for supporting an item in an upright manner, comprising:

a base portion;

a plurality of side portions hinged to the base portion so that they can be folded to be substantially flat with the base or oriented at an angle to the base for supporting said item;

biasing means responsive to said item being inserted in the stand to bias each side portion into contact with said item for support in the stand; and means for supporting each side portion at an angle to the base against the bias force direction;

wherein each side portion supporting means is releasable for folding the stand.

Preferably the stand is made from a lightweight planar sheet material, such as a plastics material and it can easily be fabricated from a sheet of plastic making it cost effective to manufacture, and strong, yet light, portable and easily collapsible.

Cardboard, ply-wood, wood or compressed board would be suitable alternative materials.

According to a preferred embodiment of the invention, an integral handle is incorporated, for example as cooperating holes in the base and one side portion. A clip or tie or strap may be used to hold the portions in their folded state for carrying. A carrying strap could be added.

The bias may be provided by any appropriate resilient member, such as by elastic cord means or by spring members. Such an arrangement is arranged to utilise the shape of the item such as a guitar and its own weight to alter the profile of the stand such that the edges of the altered profile act upon the guitar's side surfaces providing lateral restraint and maintaining the guitar in an upright position.

The elastic cord is preferably adjustable, in its point of connection to the stand, and/or adjustable vertically and horizontally, to suit different guitars, for example different sizes and shapes and weights.

A non-scratch coating or binding material may be applied to those edges of the side portions which contact the instrument in use. Preferably this is a felt-like nonwoven material. A non-scratch coating or material may be applied to, or incorporated within, the underside of the base, and an anti-slip coating or material may be applied to, or incorporated within, the surface of the base portion on which the instrument rests in use. The instrument may rest on a deformable pad or in a hollow formed in the base portion. Additional support may be provided for the guitar by a flexible sling holding the guitar within the stand. Further strength may be added to the structure by elastic cords or other resilient ties between each end so as to minimise movement of the instrument.

One or more spaces may be incorporated into the base portion, or pockets provided to hold and/or carry sheet music, spare guitar strings, guitar plectra or other paraphernalia.

The base can be designed to fit into a guitar case shaped accordingly to follow the profile of a guitar. Alternatively the stand could be clipped onto the outside of a guitar case. The stand could also or alternatively incorporate its own carrying handle or strap.

A guitar stand according to the invention is particularly advantageous since it is easy to use, quick to erect and dismantle or fold away and will also support the instrument securely at other than the true vertical: angles of up to 10° and possibly 15° and more may be achieved without danger to the instrument, depending upon the exact parameters of the particular construction (e.g. materials used, and dimensions) and of the size, weight and shape of the instrument itself. The stand is light and easily portable and very compact.

A stand may be constructed according to the invention for use in a wide variety of applications other than for the support of guitars. For example uses will be found in the support of other instruments in exhibitions and for general display purposes.

BRIEF DESCRIPTION OF THE DRAWINGS

The invention will now be described further hereinafter, by way of example only, with reference to the accompanying drawings in which:

FIG. 23 is a front part cross-sectional elevation of a stand according to yet another embodiment of the present invention;

FIG. 24 is a side part cross-sectional elevation of the stand of FIG. 23; and FIG. 25 is a front part cross-sectional elevation of a stand according to still another embodiment of the present invention.

DESCRIPTION OF THE PREFERRED EMBODIMENTS

Figure 1:
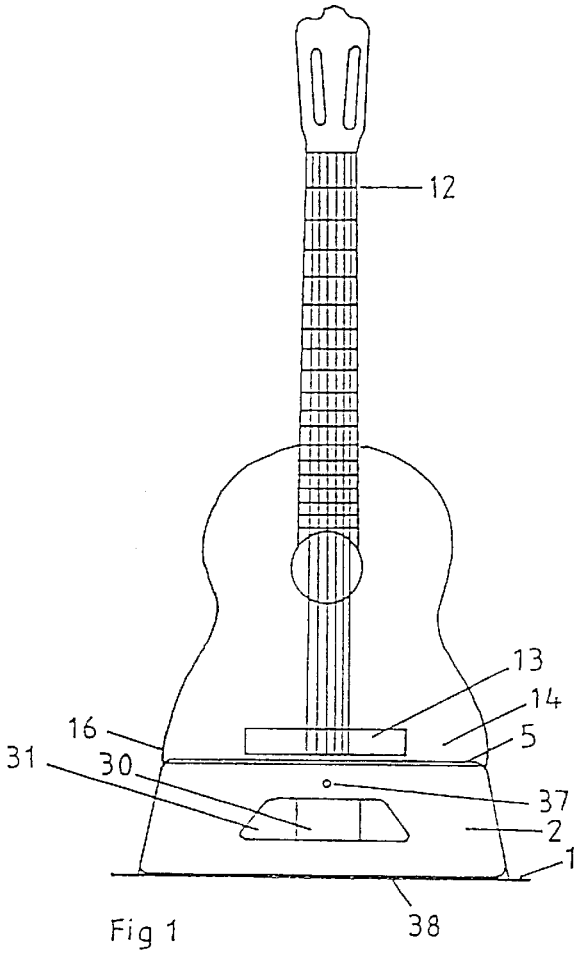
FIG. 1 shows a front elevation of a guitar in a stand according to a first embodiment of the present invention.

The FIGS. 1–14 show a stand comprising a rigid base preferably 2 mm thick and formed of plastic with four semi-rigid sides comprising side walls 2 and end walls 3, pivotally connected thereto, and each preferably having a thickness of 1.5 mm. Side packing pieces 19, 20 are provided integral with the base 1 and the sides 2 are secured in the aforementioned manner to the packing pieces by hinges 21. The ends 3 are secured in the aforementioned manner by hinges 17 to the base 1 and rigid fillets 8 and 9 are secured at locations 24, 25 to the sides 2 and ends 3 respectively by hinges 22 and 18. The locations 24, 25 define lines from which the sides 2 and ends 3 deflect inwardly during placement of the guitar in the stand.

The sides 2 and ends 3 exhibit some flexibility whereas the fillets 8, 9 and the base 1 are preferably inflexible. The side fillets 8 have tabs 39, provided at a peripheral surface remote from the point of mounting to the hinge 21, which tabs 39 are arranged to engage with chamfered inner edges of recesses 34 formed in the base 1. The tabs 39 are biased into engagement with the inner surfaces of the recesses 34 by means of elastic cords 7. Further, the end fillets 9 also include tabs 40 and these are similarly retained in recesses 35 in the base 1 by means of elastic cords 10. The provision of recesses, rather than upstanding formations, assists in limiting the thickness of the stand once collapsed.

As will be appreciated, each end 3 is connected to the base 1 by at least one elastic cord 11 and also from its top edge 6 by a membrane 29 preferably formed of a suitable anti-slip material having regard to the item to be mounted within the stand.

The cords 11 serve to bias the top edges of the ends 3 inwards and so maintain the structure in an operative condition during guitar removal. The cords 11 also serve to retain the fillets 9 in the recesses.

Further, the membrane 29 is advantageously arranged to operate in the manner of a sling and preferably comprises resiliently deformable thin sheet rubber, or similar, material.

A pad 26, which can serve as part of a sling arrangement, can also be formed of an anti-slip material, is arranged to be suspended within the stand, when assembled for use, by means of part resilient cords 27. The cords 27 are connected at one end to each of the four corners of the pad 26 and, at their opposite end, to the sides 2 of the stand by means of clip members 28. The upper surface of the pad 26 can be provided with a foam, or other deformable cellular structure, layer. The upper edges 5 of the sides 2 are provided with a cushion region which may comprise a felt-like cushioning material, and a similar material is provided to form the under surface 38 of the base 1. As will be appreciated, such felt-like material assists in preventing damage to the guitar when mounted within the stand. The cords 27 are preferably, but need not be, resilient and the clip members 28 can be arranged for connection at any one of a plurality of locations on the side 2 so that the stand can be used with a variety of guitars. Alternatively, or in addition, the cords 27 can be adjustable in length. The plurality of locations can be arranged so as to achieve a selective variation in the pressure applied to the guitar irrespective of whether the cords 27 are resilient.

A compressible pad 4 is mounted on the upper surface of the base 1 and is provided with an anti-slip top surface serving to prevent movement of the guitar once located within the stand. Preferably, the compressible pad 4 comprises a compressible rubber, or similar material.

A pair of retainers 30, comprising elasticated webbing attached to a strip of neoprene (or similar, material), is also provided and arranged such that the neoprene region comprises a lower portion of the retainer 30. The retainers 30 are affixed at their lower regions to the base 1, and at their upper regions to the top edge 5 of the sides 2. The retainers 30, which may be provided as opposed pairs, or singularly, serve to minimize the movement of the portion of the guitar received in the stand. However, it should be appreciated that retainers 30 in the form illustrated in FIGS. 1–22 are not essential to the present invention and that any functionally equivalent member(s) can be provided as discussed later.

Figure 3:
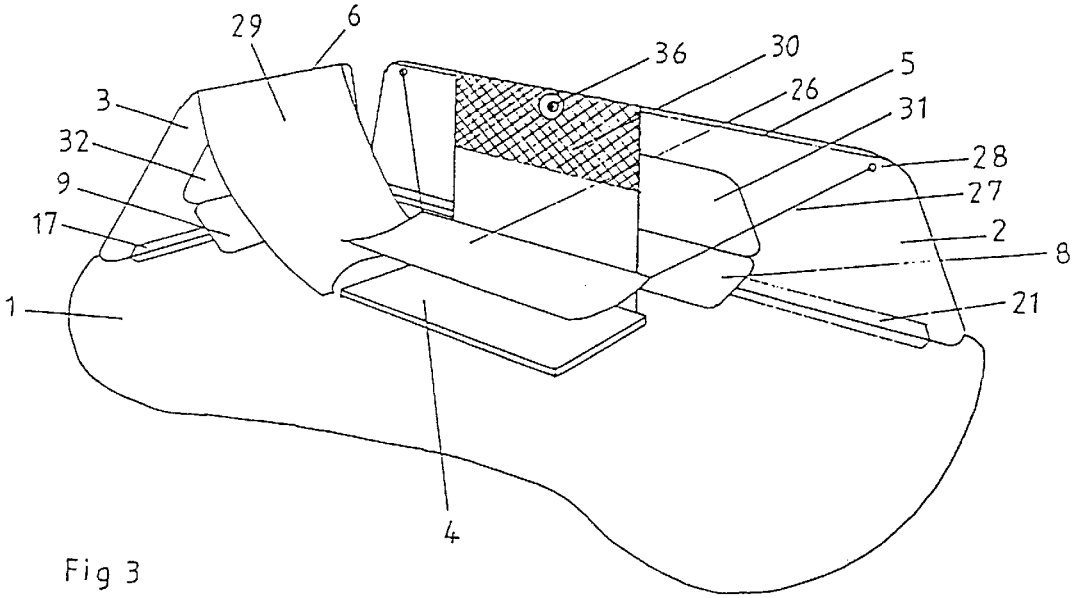
FIG. 3 is a perspective view of the main components of the stand base, one side and one end of the stand of FIG. 1.

As will be appreciated from FIG. 3, the sides 2 include apertures 31, and the ends 3 include apertures 32, which are arranged adjacent the fillets 8 and 9 respectively so that, when the stand is folded so as to adopt its storage state, the apertures 31, 32 serve to receive the respective fillets 8, 9 so as to advantageously reduce the depth of the folded structure. This can advantageously serve to minimise the thickness of the stand when collapsed.

Figure 2:
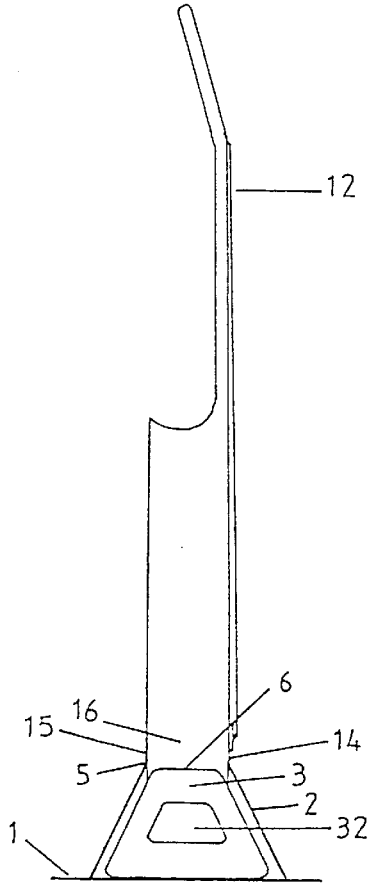
FIG. 2 shows a side elevation of a guitar in the stand of FIG. 1.

As will be appreciated, FIGS. 1 and 2 show a guitar mounted within the stand and in order to place the guitar therein, the instrument is lowered by its neck 12 through the aperture formed by the top edges 5, 6 of the sides 2 and ends 3 of the stand until the instrument comes to rest within the stand. FIGS. 4, 5, 6 and 7 show that, as the portion of the guitar below the bridge 13 passes down through the aperture, the bottom 23 of the instrument displaces the suspended pad 26 and this serves to tension the cords 27 which, in turn, urge the upper region of the sides 2 of the stand in an inwards direction towards the face 14 and back 15 of the instrument. Similarly, the sides 16 of the guitar serve to displace each membrane 29 causing the ends 3 to deflect inwardly towards the guitar. When the suspended pad 26 finally contacts the compressible pad 4 during the downward movement of the instrument, the deflection of the side 2 of the stand is such that the cushioned upper edges 5 of the sides 2 come into contact with the instruments face 14 and back 15 as noted above and, likewise, when the antislip membrane 29 is in contact with the guitar sides 16, and the lower sections of the retainers 30 are in contact with the bottom portion of the face 14 and back 15 of the instrument, the deflection of the ends 3 also serves to secure the instrument within the stand. It will therefore be appreciated that the resulting grip applied to the instrument by way of the sides 2 and ends 3 of the stand arises as a direct result of the weight of the instrument as lowered into, and supported in, the stand such that the degree with which the stand grips the instrument will advantageously be dependent upon the weight of the instrument itself. Thus, a single stand can advantageously be used with, for example, a wide variety of guitars, and a sufficient restraining force can thus be reliably applied to any one of such a selection of guitars when located within the stand in a substantially upright position.

Figure 4:
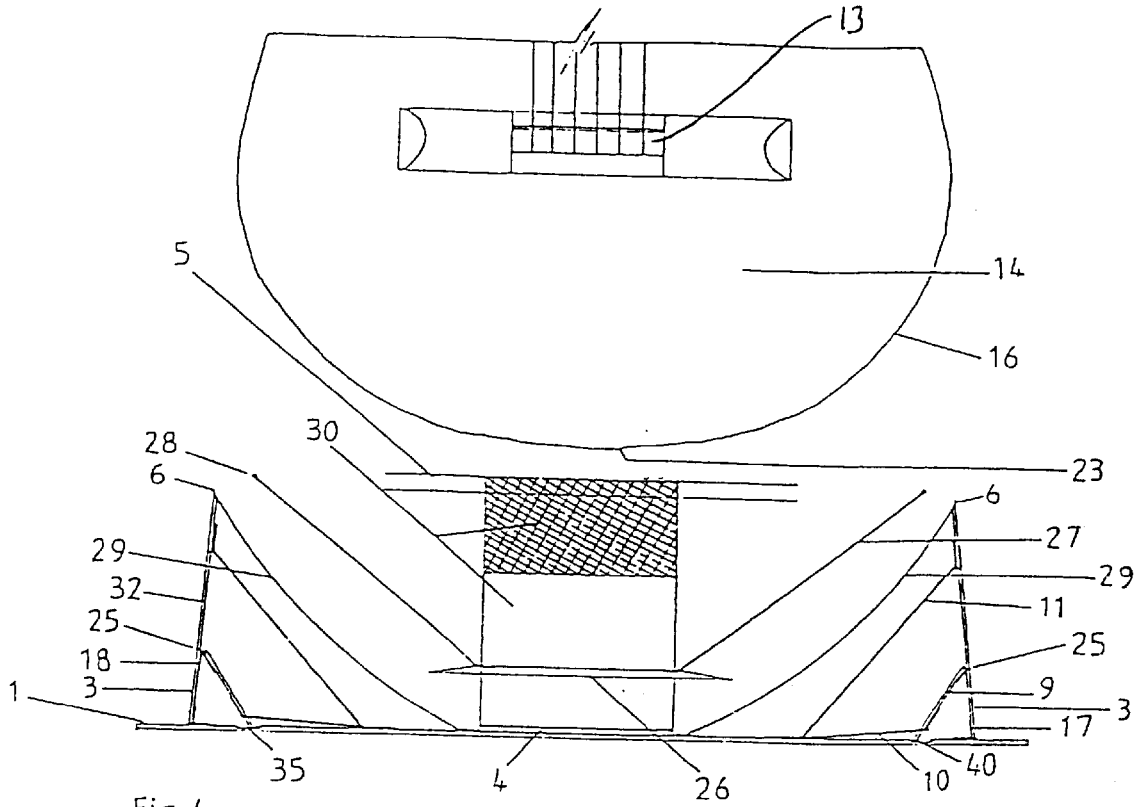
FIG. 4 is a longitudinal-sectional view through the stand of FIG. 1 as a guitar is lowered into position.
Figure 5:
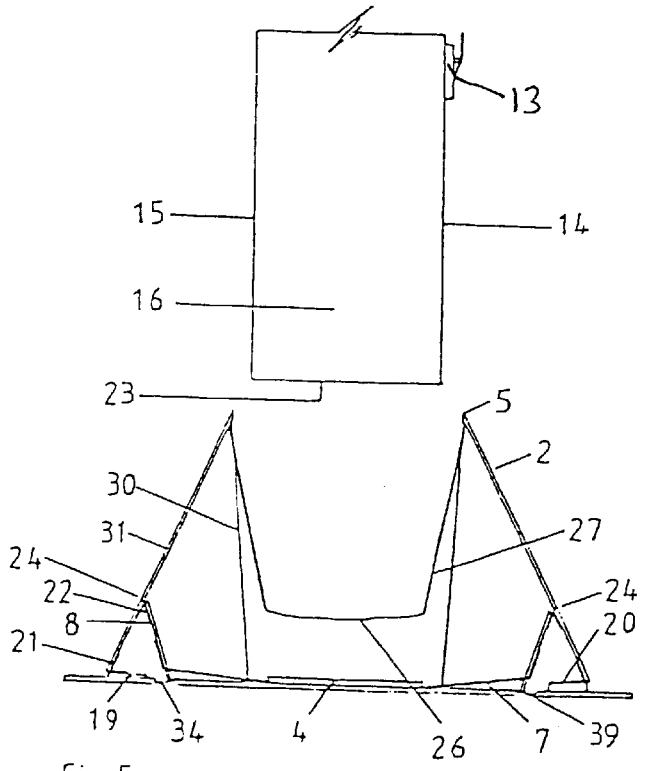
FIG. 5 is a cross-sectional view through the stand of FIG. 1 as a guitar is lowered into position.
Figure 6:
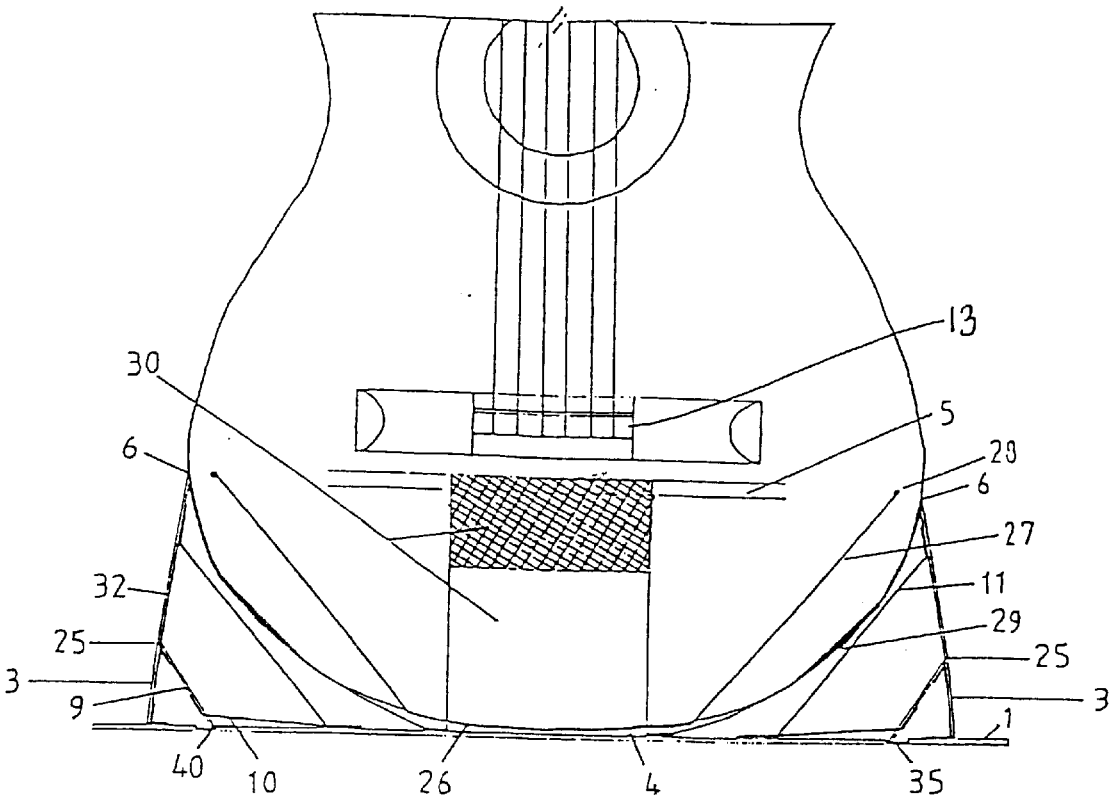
FIG. 6 shows the longitudinal section through the stand of FIG. 1 with a guitar in position.
Figure 7:
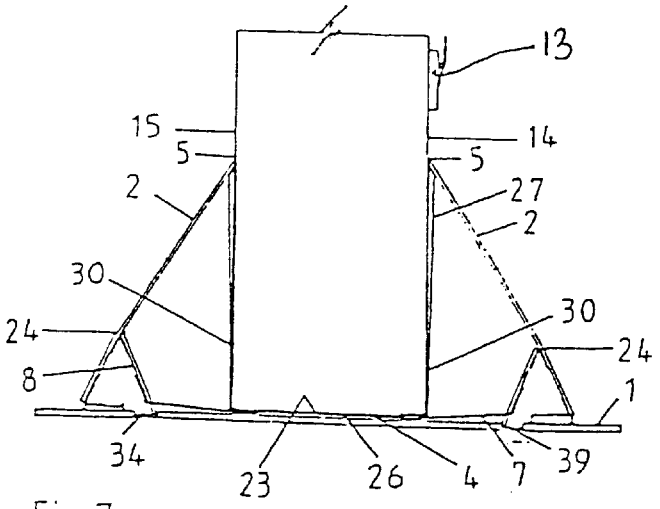
FIG. 7 shows a cross-section through the stand of FIG. 1 with a guitar in position.
Figure 8:
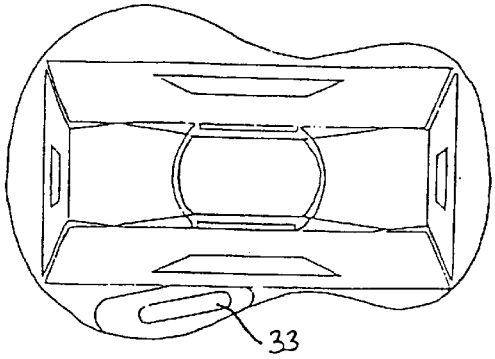
FIG. 8 shows a plan view of the stand of FIG. 1 once assembled for receiving a guitar.
Figure 9:
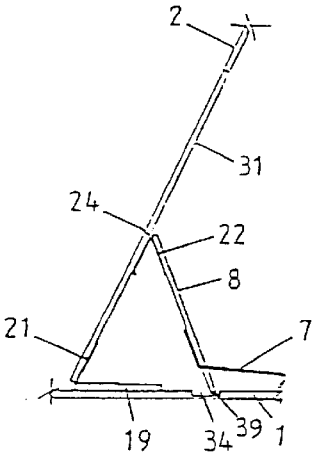
FIG. 9 is a cross-sectional view of the junction of the base, side and side fillet of the stand of FIG. 1 and assembled for use.
Figure 10:
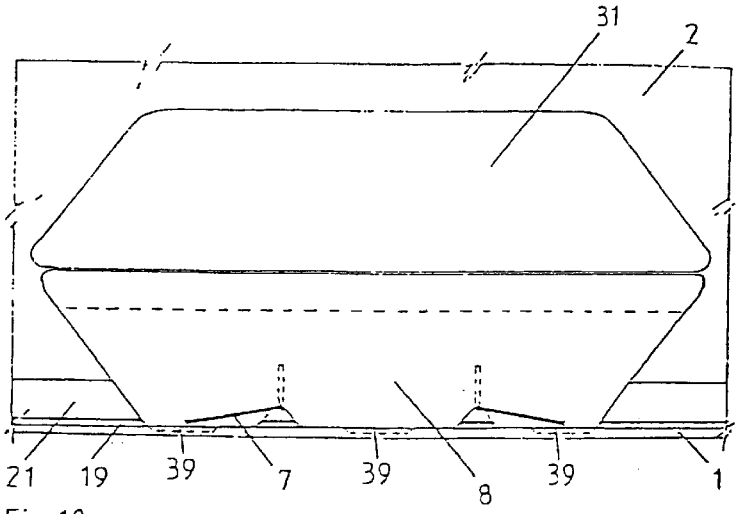
FIG. 10 is a side elevation of the junction of the base, side and side fillet of the stand of FIG. 1 and assembled for use.

As the guitar is raised out of the stand so that the suspended pad 26 moves out of engagement with the compressible pad 4, the tension in the part-resilient cords 27, and in the membranes 29, decreases so as to reduce the frictional contact between the stand and the guitar so as to allow for smooth removal of the guitar from the stand in a damage-free manner. As will be appreciated, the aforementioned reduction in tension in the cords 27 and the membranes 29 serves to allow the top edges of the sides 2 and ends 3 of the stand to move outwardly away from the guitar and towards their rest positions as shown in FIGS. 4 and 5 so as to allow for the ready removal of the instrument as noted above.

Figure 12A:
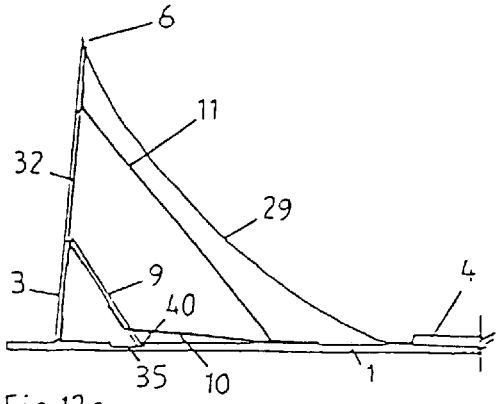
FIGS. 12A, 12B and 12C show, in sequence, the collapsing of one of the ends of the stand of FIG. 1.
Figure 12B:
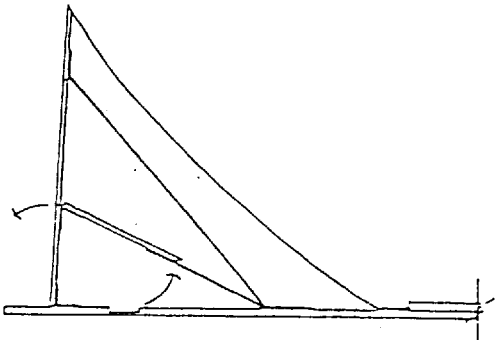
Figure 12C:
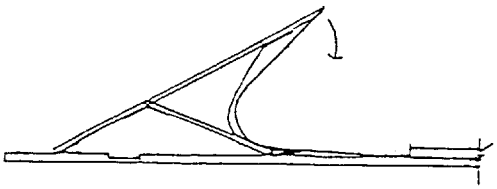

It will be appreciated that a further advantage of the invention arises in that the stand can be readily folded, and collapsed, into a shallow form and, to assist the formation of such a structure, the sides 2 and ends 3 are advantageously arranged so that they can be folded into a position in which they are substantially parallel to the base 1 of the stand. FIGS. 12 and 13 illustrate how the stand can be folded and collapsed from the initial form as shown in FIG. 3 so that it adopts the aforementioned storage form. FIGS. 12A, B and C illustrate how outward pressure can be applied through the end aperture 32 to the end fillet 9 so as to allow the elastic cord 10 to lift the fillet tabs 40 out of the recesses 35. Once the tabs 40 are removed from engagement with the recesses 35, the tension in the cords 10, 11, and in the membrane 29, causes the ends 3 to rotate about the hinges 17 in a clockwise manner as shown in FIGS. 12A, B and C and so as to arrive at a collapsed folded position as shown in FIG. 14.

Figure 13A:
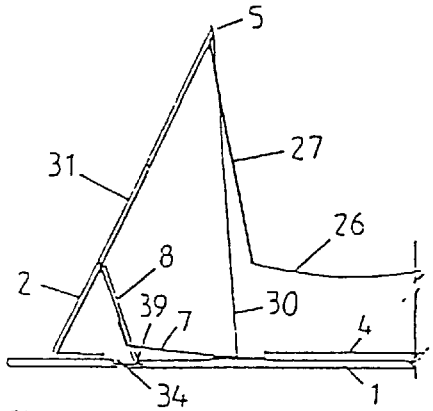
FIGS. 13A, 13B and 13C show, in sequence, the collapsing of one side of the stand of FIG. 1.
Figure 13B:
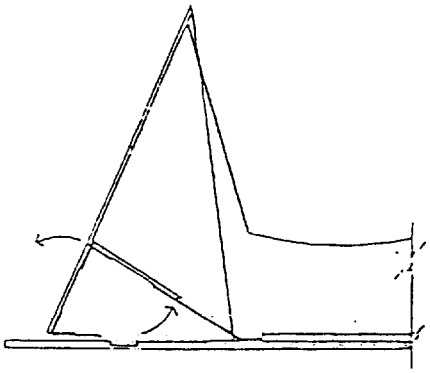
Figure 13C:
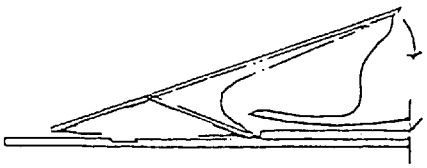
Figure 14:
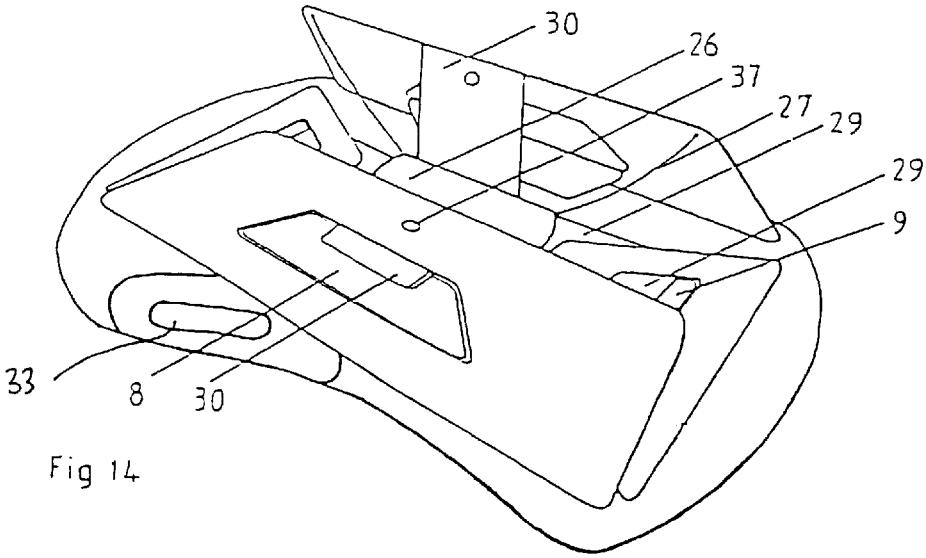
FIG. 14 is a perspective view of the stand of FIG. 1 with its two ends and one side collapsed.

FIGS. 13A, B and C illustrate how the sides 2 of the stand can be collapsed in a manner similar to the collapsing of the ends 3 and so as to move towards the folded collapsed state as shown in FIG. 14.

Once in the collapsed state, the clip member 36 (see FIG. 3) and located in the inner face of the one of the sides 2 of the stand, engages with a clip engagement member 37 (see FIG. 1)formed on the other of the sides 2 of the stand so as to secure the stand in its shallow, collapsed and closed position.

As will be appreciated from FIG. 14, when in its collapsed state, the sides 2 are arranged to overlap, and also to overlap the ends 3. If, in the circumstances that arise, this is considered to lead to a disadvantageous increase in the thickness of the collapsed stand, then the sides 2 and ends 3 can be dimensioned so that no overlapping occurs. To prevent overlapping of the sides, the edges of the sides remote from the point of pivotal connection to the base 1 can advantageously be provided with formations, for example castellations, which are arranged to become interleaved upon collapsing the sides towards each other. In this manner, the compensating formations formed by the castellation allow particular height dimensions of the sides to be maintained while ensuring that the thickness of the collapsed stand is minimized by preventing any overlap between the edges of the sides remote from the hinges associated therewith. Of course, any appropriate formations other than castellation can be provided for this purpose in as much as they provide for interleaving between the formations of the two sides. If desired, such interleaving can also be achieved between the sides and the ends of the stand by the provision of further appropriate interleaving formations. As an alternative, the sides and or ends of the stand can be provided with recess formations so that opposite sides and ends can be keyed together when folded to reduce the overall thickness.

Figure 11:
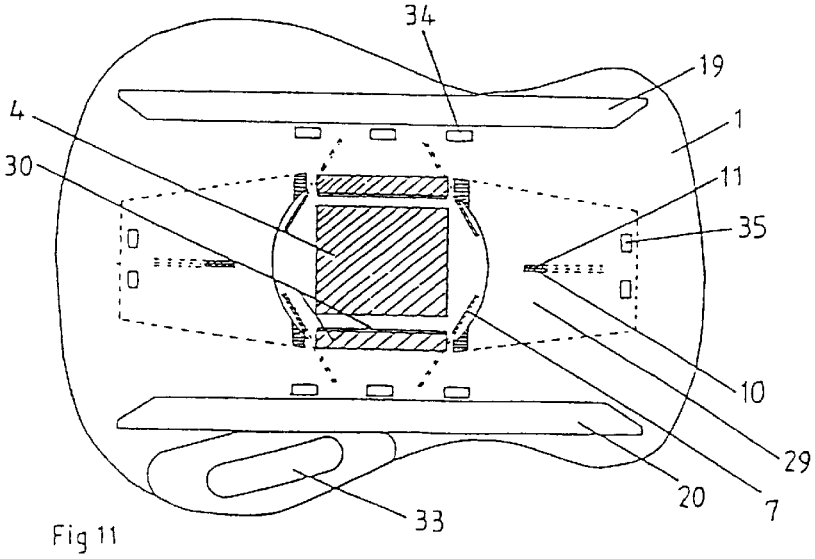
FIG. 11 comprises a plan view of the base of the stand of FIG. 1.

It will be appreciated that the stand may then be readily carried by means of the carrying handle 33 formed through a peripheral portion of the base 1 and as shown in FIG. 11. Also, the stand may now be readily placed within the bottom of a guitar case and with its non-scratch face 38 facing upwardly so that when a guitar is subsequently placed in the case, only the non-scratch surface 38 of the stand comes into contact with the guitar body.

As will be appreciated, the stand can be readily erected from its shallow collapsed form by releasing the clip means 36, 37 and reversing the folding process illustrated in FIGS. 12 and 13.

The embodiment of the present invention as described above proves particularly advantageous for use in supporting an item where the prevention of damage to the item is a particular consideration and, in particular, where the item needs to be supported in a particularly stable manner whilst still allowing for the stand to be collapsed into a readily portable, for example, shallow, form.

The use of the relatively wide retaining portions 30, anti-slip suspended pad 26 and anti-slip membranes 29 advantageously serves to provide for a reliable frictional contact to the item to be supported whilst likewise reducing the likelihood of the item becoming damaged. The contoured base 1, as illustrated with reference to FIGS. 1–14, also serves to increase the stability of the stand while only requiring an increased width in certain regions of the base.

The base and/or sides and ends can be formed of any appropriate material and can be formed by any appropriate process but, in accordance with a simple manner for providing the recesses discussed above, the base 1 can comprise a two-ply member wherein an aperture member is affixed over a correspondingly shaped solid base layer. Also, the base and/or sides and end can be formed of foamed PVC.

Although, with reference to FIGS. 1–14, each of the sides 2 is provided with only one engagement formation for receiving the clip member 28 located at the end of each resilient cord 27, the sides 2 can alternatively be formed with a series of adjacent engagement formations so that the exact point of connection of the cords 27 to the sides 2 can be selected, and varied, as required. This can advantageously serve in allowing for a variation in the tension established within the cords 27 and thus the pressure applied by the sides 2 to the instrument when mounted within the stand. As mentioned previously, cords 27 of different length, or that are adjustable in length, can also be provided for exerting different forces on the guitar body. Also, the embodiment as illustrated in FIGS. 1–14 is advantageously provided with rounded corners so as to reduce the likelihood of damaging other objects, and in particular the item to be supported, when being arranged for use.

As an alternative feature for the embodiment disclosed by reference to FIGS. 1–14, it should be appreciated that the sides 2 and ends 3 of the stand can comprise rigid, non-flexible, members having some form of, preferably resilient, cushioning member located along the inner surface thereof. Such a cushioning member is then advantageously deformed as the sides 2 are urged towards the guitar body upon reception of the guitar into the stand. Such cushioning members comprise any appropriate cushion formation but, according to one particular embodiment, the cushioning members comprise cylindrical foam members extending along the upper portion of the inside surface of each of the sides 2 and ends 3.

The FIGS. 15 to 22 show a stand according to another embodiment of the invention and comprising a rigid base 51 with two semi-rigid sides 52 and two semi-rigid ends 53. Side stops 59, end stops 512, side packing pieces 523 and end packing pieces 522 are integral with the base. The sides are secured by hinges 524*a* to the packing pieces, the ends by hinges 521*a*. Rigid fillets 58 are secured to the sides by hinges 524*b*, rigid fillets 511 to the ends by hinges 521*b*. The sides and ends have some flexibility whereas the fillets and the base should not be flexible. The side fillets 58 are retained at their lower edges by tension in elastic strips 57 and by side stops 59. The end fillets 511 are similarly retained by elastic cords 513 and by the end stops 512. The two sides 52 are connected together by at least two elastic cords 510. Each end 53 is connected to the base 51 by at least one elastic cord 514. The top edges 55 of the sides 52 are covered or coated with cushioned anti-slip material, as are the top edges 56 of the ends 53. A compressible pad 54, secured to the base, has an anti-slip top surface. It should be appreciated that the elastic cords of this embodiment can be provided with different, or adjustable, lengths so as to allow for a variation in the forces exerted. Further, the locations at which the cords, are attached to the body can also be varied so as to alter the forces exerted through the cords. Also, the elastic cords can advantageously be arranged to provide non-slip engagement to the guitar body to prevent movement such as slippage within the stand.

The respective cooperating edges of the fillets 58, 511 and the side and end stops 59, 512 may be chamfered to more positively locate and retain the fillets at their bottom edges and to resist the tendency for the fillets to pull upwards at their ends under the influence of the elastic strips 57.

Figure 15:
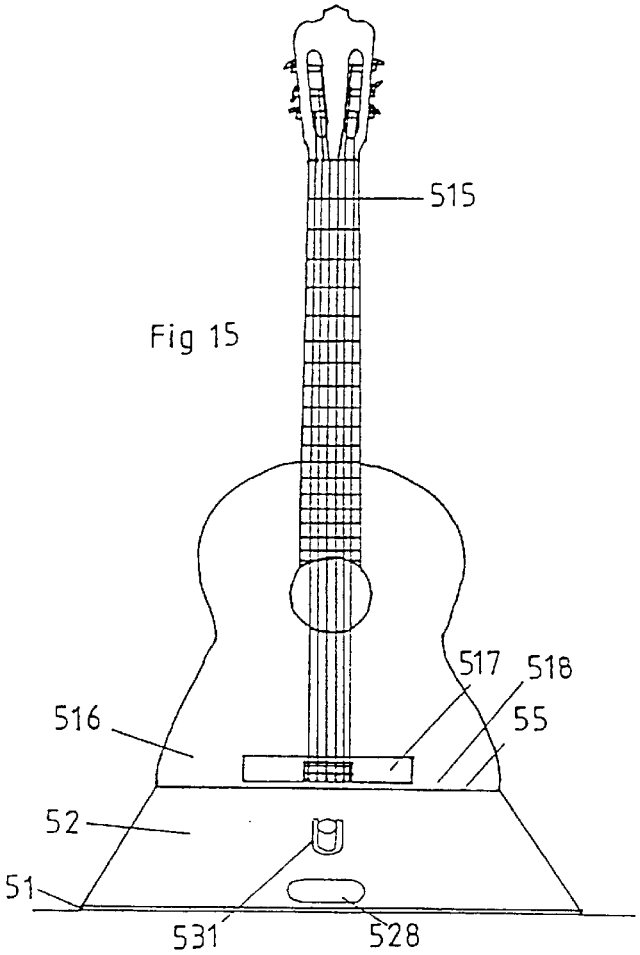
FIG. 15 shows a front elevation of a guitar in a stand according to another embodiment of the present invention.
Figure 16:
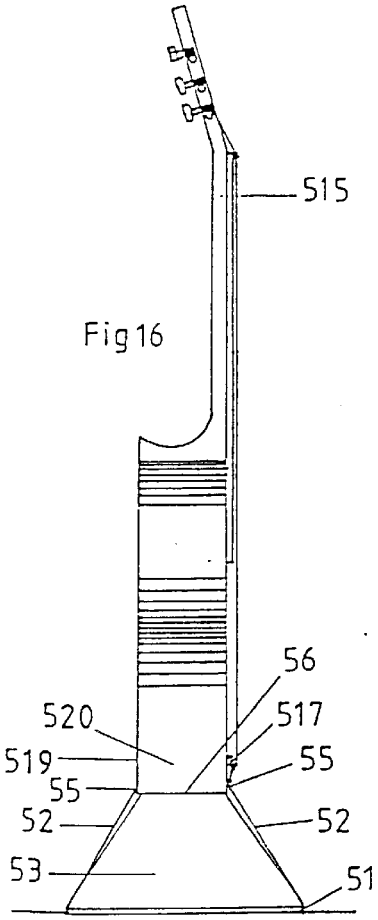
FIG. 16 shows a side elevation of a guitar in the stand of FIG. 15.
Figure 17:
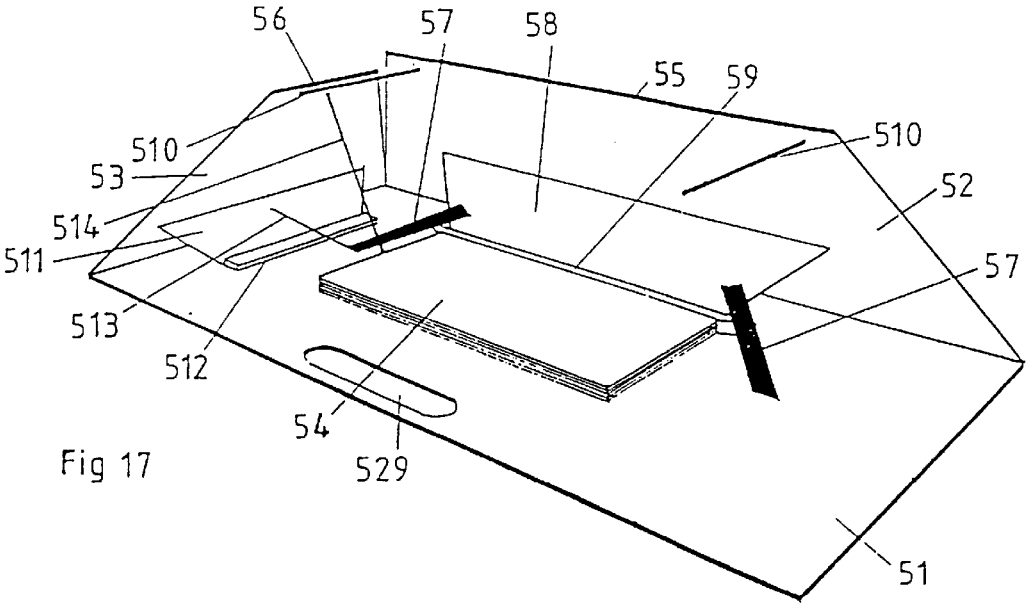
FIG. 17 shows in perspective, the main components of the stand base, one side and one end of the stand of FIG. 15.
Figure 18:
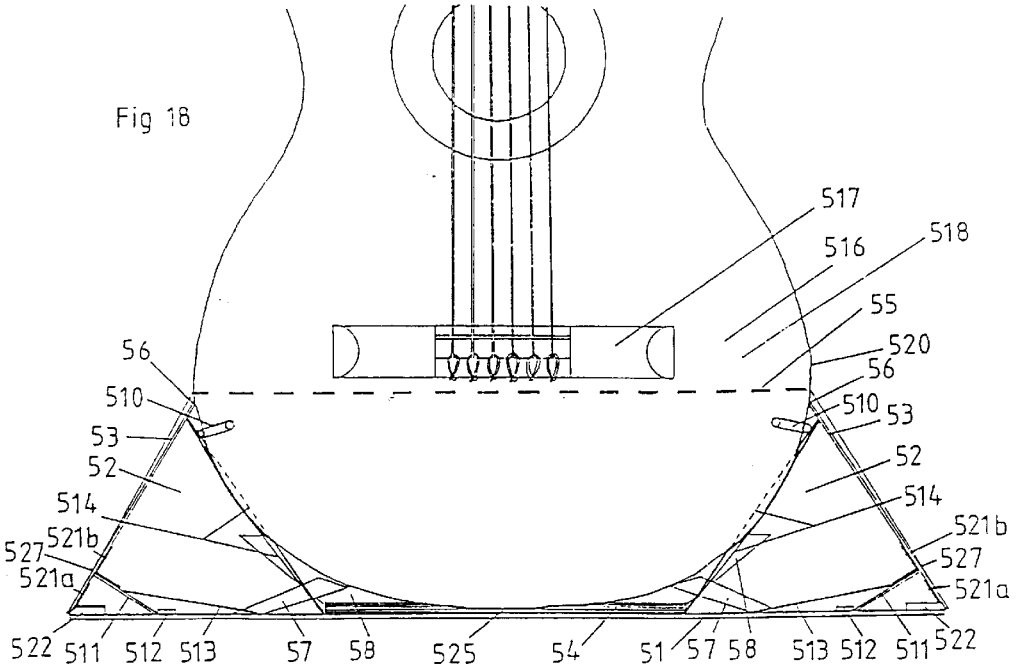
FIG. 18 shows a longitudinal-section through the stand of FIG. 15 with a guitar in position.
Figure 19:
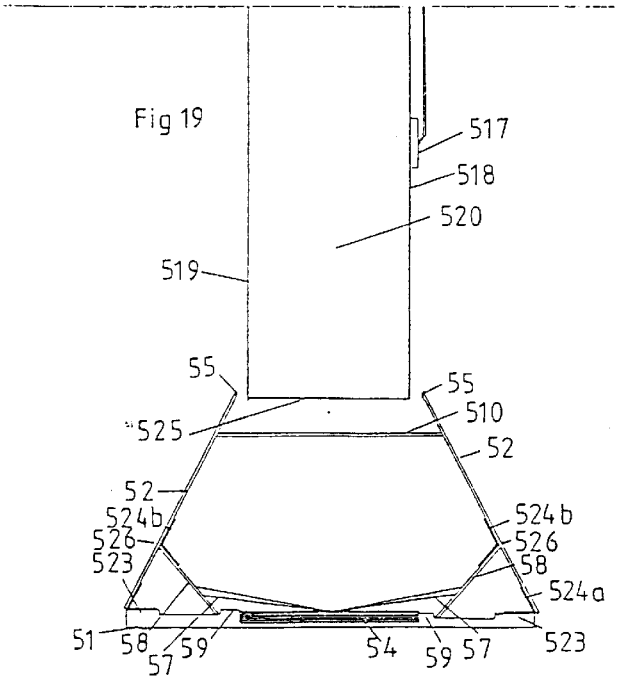
FIG. 19 shows a cross-section through the stand of FIG. 15 as a guitar is lowered into position.
Figure 20:
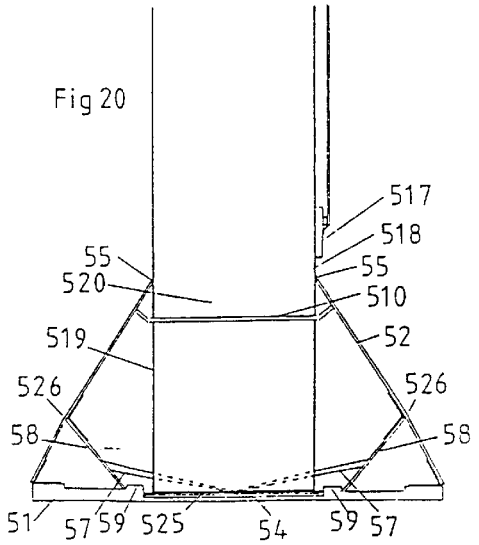
FIG. 20 shows a cross-section through the stand of FIG. 15 after a guitar has been lowered into position.

FIGS. 15 and 16 show a guitar in the stand. In order to place the guitar in the stand the instrument is held upright by the neck 515 and is lowered through the aperture formed by the top edges 55, 56 of the sides 52 and ends 53 of the stand until the instrument comes to rest in the stand as shown in FIGS. 15 and 16. FIGS. 18, 19 and 20 show that, as the lower bout 516 of the guitar passes down through the aperture, the sides 520 of the instrument displace and stretch the elastic cords 510 and 514. The resulting tension in the cords causes the sides 52 of the stand to deflect inwards from their fixed line 526 and the ends 53 to similarly deflect from line 527. When the bottom 525 of the instrument reaches and compresses the anti-slip pad 54 the deflection of the sides and ends is such that the anti-slip edges 55 and 56 are pressing against the guitar's top 518 just below the bridge 517, its back 519 and sides 520 with sufficient force to maintain the instrument in an upright position.

As the guitar is raised from the pad the resulting decrease in tension in the cords allows the top edges of the stand to move outwards to their original positions permitting the withdrawal of the instrument through the aperture formed by the top edges 55, 56.

Figure 21A:
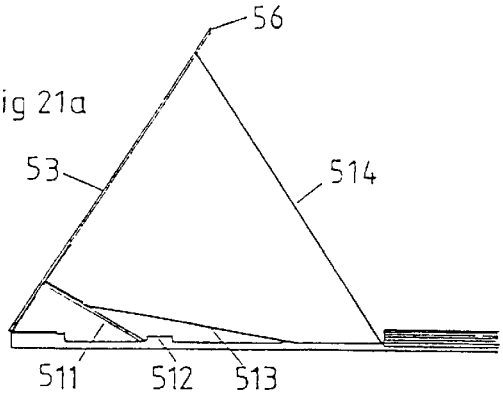
FIGS. 21A, B, and C show in sequence the collapsing of one of the ends of the stand of FIG. 15.
Figure 22A:
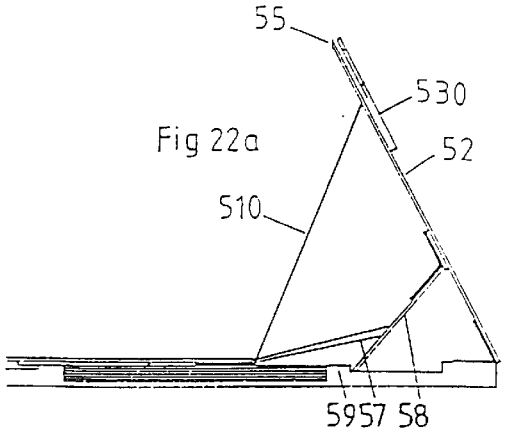
FIGS. 22A, B and C show in sequence the collapsing of the second side of the stand of FIG. 15.
Figure 21B:
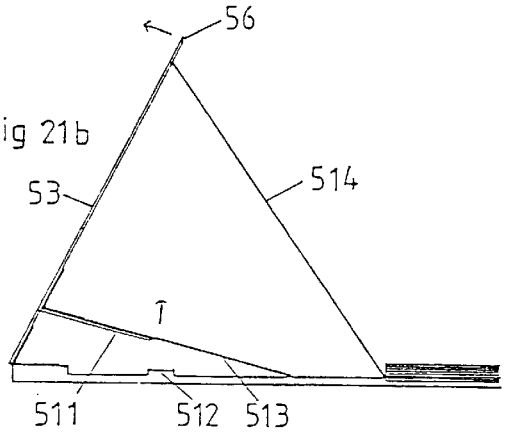
Figure 22B:
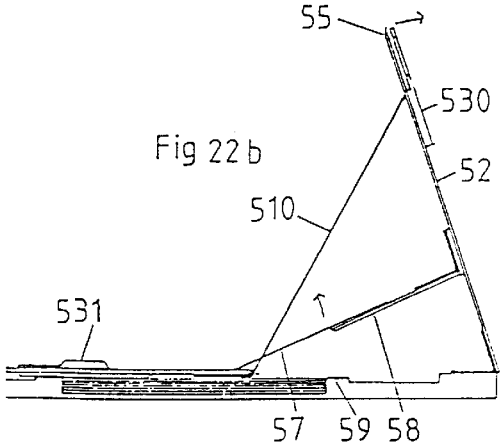
Figure 21C:
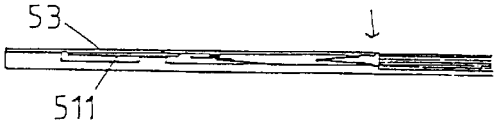
Figure 22C:
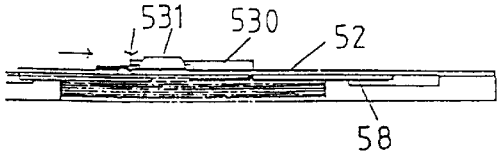

To enable the stand to be carried easily the ends and sides can be collapsed so that the stand forms a slim rectangle. FIGS. 21 and 22 show how this is done. The end 53 is pulled outwards at the top edge 56 causing the elastic cord 513 to lift the bottom edge of the end fillet 511 clear of the stop 512. When the outward pressure at the top edges is removed, the tension in the cords 513 and 514 causes the ends 53 to rotate inwards and downwards to a collapsed position as shown in FIG. 21*c*. The sides 52 are collapsed in a similar manner, as shown in FIGS. 22*a*, 22*b* and 22*c*. When so collapsed the hole 528 in one side aligns with hole 529 in the base to form a handle. Clip 531 on one of the sides may be slid into its counterpart 530 on the other side to secure the stand in its closed position.

To erect the stand the above procedure is reversed and pressure is applied to the faces of the fillets 58 and 511 to locate their bottom edges against the stops 59 and 512.

FIGS. 23 and 24 illustrate a particularly important alternative feature which can be included in any embodiment of the present invention and which serves to prevent lateral movement of the guitar body 614 once located within the stand. The main feature comprises providing the pad 604, which is located on the base of the stand and which corresponds to the pad 4 of the first embodiment illustrated with reference to the accompanying drawings, as a compressible pad 604 preferably formed of foam and, in particular, formed of so-called egg-box foam, i.e. with a series of peaks and troughs on its upper surface. The foam pad 604 is advantageously arranged to form a foot print on the base of the stand which, as illustrated with reference to FIGS. 23 and 24, has a greater width than the lower portion of the guitar body 614 as received in the stand.

With particular reference to FIG. 24, it will be appreciated that peripheral portions 604*a* of the deformable foam pad 604 will not be influenced by the guitar body and so, in their uncompressed state, those peripheral portions 604*a* will form a lip extending along the lower edge of the guitar body 614 as received in the stand.

The provision of such a deformable pad 604 renders the retainers 30 illustrated in the embodiment of FIGS. 1–14, unnecessary and advantageously can further simplify the structure of the present invention.

The deformable pad 604 can advantageously be used in combination with a sling means which allows for direct contact between a base portion of the guitar body 614 and the pad 604. Such a sling means can therefore comprise two separate and, in particular, membrane-like sling members extending between the upper edges of the sides of the stand. Alternatively, at least one sling member can be provided having at least one aperture formed therein. In particular, the sling means can comprise a sling member arranged to receive the base portion of the guitar body 614 as it is lowered into the stand and which presents, preferably in a latticed manner, a series of apertures which allow for contact between the base of the guitar body 614 and the upper surface of the deformable pad 604. Such contact between the surfaces is particularly enhanced in an embodiment in which the pad 604 is formed of egg-box foam since the peaks then provided advantageously extend upwardly through the aforementioned apertures formed in the sling means.

However, it should be appreciated that a sling means of this nature can also be provided within an embodiment of the present invention in which the pad is absent.

As will in any case be appreciated by reference to FIGS. 23 and 24, the compressible pad 604 need merely be incorporated into a stand structure having sides 632 and fillets 609 are similar nature to those discussed in relation to the other embodiments disclosed herein. The upper edges of the sides and/or the ends of the stand of any particular embodiment of the present invention can be provided with a resilient member, for example a member formed of a cellular structure such as foam, and which extends along the length of the upper edge 605 (see for example FIG. 24) and which is deformed upon contact with the sides 616 of the guitar body 614.

As another alternative feature, the deformable pad can be provided as at least two pad members arranged adjacent the suspended pad. In particular, the pad members can be located to the left and right of the suspended pad 726 as shown in FIG. 25. In this manner, as the guitar is lowered onto the suspended pad 726 and, as the guitar moves further downwardly in the stand, the regions of the guitar are extending either side of the suspended pad 726 contact the at least two deformable pads 704*a*, 704*b* so as to prevent movement of the guitar base in the stand. The suspended pad 726 can move into contact with the stand base in the gap shown by arrows A formed between the pads. Advantageously, cord members 776, 777 can be provided between the suspended pad and the deformable pads 704*a*, 704*b* so as to retain the suspended pad centrally located.

It will be seen that the effectiveness of a stand according to the present invention is determined by the forces and biasing strengths in the triangle formed in cross-section between the base and the two top edges of the sides, and also in the triangle formed in cross-section between the base and the two top edges of the ends.

Of course the skilled person will see that there are many alternative ways of constructing the stand according to the invention. For example, the fillets may be released by closing downwards instead of upwards or could be pivotally connected to the base. The elastic cords 57, 510, 513 and 514 could be of many suitable resilient materials or may be fine springs or another resilient fastening or mechanism. In this case the springs would be covered, or arranged to avoid direct contact and possible consequential damage of the instrument.

It will therefore be appreciated that particular advantages arise with the present invention in that an advantageously collapsible, and light weight, device for supporting an object in an upright manner can be provided. In particular, the collapsed form of the support device is advantageously shallow although it can be quickly and easily erected, and collapsed, as required. The stand is also arranged so as to minimize the likelihood of the item being supported becoming damaged and, as a particular feature, the stand utilizes the weight of the item being supported to deform item-engaging formations of the stand so as to provide secure support for the item.

Also, should the guitar and/or stand be knocked, the stand advantageously serves to delay the fall of the guitar since it allows movement of the guitar away from the vertical, through deformation of the wall, and so as to prevent immediate toppling of the guitar.

It should be appreciated from the above that the invention is not restricted to the details of the foregoing embodiments. For example, the elasticated cords illustrated could readily be replaced by any appropriate resilient means, for example, fine spring elements and, indeed, the cords from which the pad 26 of the embodiment of FIGS. 1–14 is suspended could actually be provided in a non-flexible/elastic/resilient form.

Also, any suitable form of clip arrangement for attaching the cords 27 to the sides 2 of the FIGS. 1–14 embodiment could be provided having particular regard to the requirement for varying the location at which the cords 27 are connected to the sides 2. Further, any appropriate hinge mechanism could be utilized in place of the hinges illustrated in combination with the sides and ends of the stands illustrated herein. For example, a series of male/female interlocking members allowing for rotation could likewise be provided.

In particular, a stand according to any particular embodiment the present invention can be formed integrally with a guitar case. In this manner, the base of the stand is formed directly from the base portion of the case.

Further, in place of the retainer member 30 as illustrated with reference to FIGS. 1–14, there could be provided a pair of cord members strung between the inner faces of the stand ends 3.

The hinge features for the ends, sides and fillets could be provided integrally with such features particularly if the ends, sides and fillets etc. are formed of an appropriate material, for example polypropylene. Of course, the stand can be made from any appropriate material which may advantageously be transparent or generally serve some additional technical and/or aesthetic purpose.

Also, the dimensions of the fillets, and the spacing of the formations provided in the base are chosen such that when the stand is stored, the hinge portion of each fillet can engage with said base formations such as the recesses discussed.

The stand may of course be provided with any selection of features discussed in relation to all of the drawings of the present application.

Also, the upper edge 5 of at least one of the sides 2 of the stand can be provided with a cut-out so as to receive the bridge of a guitar therein. The retainer can then be arranged to extend to connect each portion of the upper edge 5 adjacent the cut-out. Also, the upper edge of the sides and/or ends may be provided with a liner of resilient material such as foam piping.

The pad 4 and base 1 can also be provided with a recess for receiving a formation found at the base 23 of the guitar, for example a pick-up output socket or a strap attachment stud.

Appropriately positioned apertures may also be provided in at least one of the base, sides and ends, so as to reduce the weight of the stand.

I claim:

1. A stand for supporting an item in an upright manner, comprising:

a base portion;

a plurality of side portions hinged to the base portion so that said plurality of side portions can be folded to be substantially flat with the base or oriented at an angle to the base for supporting said item;

biasing means adapted to be responsive to said item being inserted in the stand to bias each side portion into adapted to be in contact with said item for support in the stand; and means for supporting each said side portion at an angle to the base against a bias force direction;

wherein each said side portion supporting means is releasable for folding the stand.

2. The stand according to claim 1, wherein said biasing means comprises resilient means arranged to be deformed by said item.

3. The stand according to claim 1, wherein a location at which said biasing means contacts said side portions can be varied.

4. The stand according to claim 1, wherein said biasing means comprises a sling means.

5. The stand according to claim 1, wherein said biasing means comprises a receiving means for receiving said item, said receiving member being connected to said side portions by a plurality of resilient members.

6. The stand according to claim 5, wherein said receiving means is arranged to be suspended within said stand by said resilient members.

7. The stand as claimed in claim 5, wherein the receiving means comprises a member having a foam layer formed thereon.

8. The stand according to claim 5, wherein the receiving means comprises at least one sling means arranged to allow for direct contact between a surface of the item being received in the stand and a portion of the stand located beneath the sling means.

9. The stand according to claim 8, wherein the at least one sling means comprises at least one thin membrane member.

10. The stand according to claim 8, wherein the sling means is formed with at least one aperture therein so as to allow for the direct contact.

11. The stand according to claim 10, wherein the sling means comprises a lattice member.

12. The stand according to claim 1, wherein said biasing means is arranged for direct connection between said base portion and at least one of said side portions.

13. The stand according to claim 12, wherein said biasing means for extending directly between said side portions and said base portion comprises a ribbon like member.

14. The stand according to claim 1, wherein said biasing means is arranged to extend between mutually opposite side portions of the stand.

15. The stand according to any one of claims 1, wherein a first biasing means is connected to a first mutual opposite pair of said side portions and comprises a receiving member for receiving said item and connected to said side portions by a plurality of resilient members, and a second biasing means for a second pair of mutually opposite side portions is arranged to extend directly between the side portions of said second pair and said base portion.

16. The stand according to claim 1 and including a retainer member extending between at least one of said side portions and said base portion and serving to restrict movement of said item within the stand.

17. The stand according to claim 16, wherein said retainer member comprises a resilient ribbon like member.

18. The stand according to claim 17, wherein said means for supporting each side portion comprises a fillet member.

19. The stand according to claim 18, wherein said fillet member is hinged to a side portion and is arranged to engage with an engagement formation in said base portion.

20. The stand according to claim 18, wherein said means for supporting each side portion is located adjacent an aperture in said side portion so as to be received therein when said side portion is folded to be substantially flat with the base portion.

21. The stand according to claim 1 made from a plastics material.

22. The stand according to claim 21, fabricated in the form of a planar sheet of plastics material.

23. The stand according to claim 1, wherein the stand is made from any one of any combination of cardboard, ply-wood, wood and compressed board.

24. The stand according to claim 23, wherein the handle comprises a carrying strap.

25. The stand according to claim 1 comprising an integral handle.

26. The stand according to claim 25, wherein the handle comprises an aperture in the base portion.

27. The stand according to claim 1 comprising means for holding the portions in their folded state for carrying.

28. The stand according to claim 27, wherein the holding means comprises a clip or tie or strap.

29. The stand according to claim 1 wherein the biasing means includes elastic cord material.

30. The stand according to claim 1 wherein said biasing means is adapted to be arranged to utilize the shape of the item and its weight to alter the profile of the stand such that the edges of the stand act upon the item's side surfaces providing lateral restraint and maintaining the item in an upright position.

31. The stand according to claim 1 wherein the biasing means is adjustable, vertically and horizontally, to accommodate different items.

32. The stand according to claim 31, wherein the non-scratch coating comprises a felt-like material.

33. The stand according to claim 1 comprising a non-scratch coating material applied to those edges of the side portions which contact the item in use.

34. The stand according to claim 1 comprising a non-slip coating applied to said surfaces of said biasing means.

35. The stand according to claim 1 comprising a deformable pad attached to the base portion.

36. The stand according to claim 35, wherein the deformable pad is formed of a cellular structure.

37. The stand according to claim 36, wherein the deformable pad comprises a foam pad.

38. The stand according to claim 37, wherein the foam pad is formed from egg-box foam.

39. The stand according to claim 31, wherein at least one lateral dimensions of a foot-print provided by the deformable pad is adapted to be greater than the corresponding portion of the item to be received on the pad so that the peripheral portions of the deformable pad are not deformed when the object is received by the stand.

40. The stand according to claim 1 and including storage space in the base portion.

41. The stand according to claim 1 wherein the base of the stand is shaped to follow the profile of a guitar body.

42. The stand according to claim 1 comprising a clip for clipping the stand onto the outside of a guitar case.

* * * * *